US007477753B2

(12) United States Patent
Buckley et al.

(10) Patent No.: US 7,477,753 B2
(45) Date of Patent: Jan. 13, 2009

(54) HEARING AID PROTECTIVE PACKAGING ASSEMBLY

(75) Inventors: James P. Buckley, San Jose, CA (US); Robert Schindler, San Francisco, CA (US); Pat Contioso, Sunnyvale, CA (US); John Sadler, Belmont, CA (US)

(73) Assignee: InSound Medical, Inc., Newark, CA (US)

( * ) Notice: Subject to any disclaimer, the term of this patent is extended or adjusted under 35 U.S.C. 154(b) by 492 days.

(21) Appl. No.: 11/327,283

(22) Filed: Jan. 5, 2006

(65) Prior Publication Data

US 2007/0154042 A1 Jul. 5, 2007

(51) Int. Cl.
*H04R 25/00* (2006.01)

(52) U.S. Cl. ..... 381/312; 381/323; 381/314; 381/328

(58) Field of Classification Search ..... 206/522, 206/204, 320; 381/323, 380; 429/27
See application file for complete search history.

(56) References Cited

U.S. PATENT DOCUMENTS 4,793,717 A * 12/1988 Manske ..... 374/160
5,640,783 A * 6/1997 Schumaier ..... 34/219
6,257,402 B1 * 7/2001 Hedman ..... 206/204
6,410,997 B1 * 6/2002 Sjursen et al. ..... 307/130
2003/0165250 A1 * 9/2003 Garber et al. ..... 381/322
2004/0240695 A1 * 12/2004 Leedom et al. ..... 381/328
2005/0226446 A1 * 10/2005 Luo et al. ..... 381/312

OTHER PUBLICATIONS

International Search Report and Written Opinion of PCT Application No. PCT/US07/60179, dated Jul. 15, 2008, 14 pages total.

* cited by examiner

*Primary Examiner*—Suhan Ni
*Assistant Examiner*—Ryan C Robinson
(74) *Attorney, Agent, or Firm*—Townsend and Townsend and Crew LLP

(57) ABSTRACT

Embodiments of the invention provide systems, assemblies and methods for packaging hearing devices to protect them during shipping and storage. Many embodiments provide packaging systems that allow metal-air battery powered hearing aids to be stored for several months or longer with a live battery and then ready for use upon opening of the packaging. One embodiment provides a packaging system for a hearing aid comprising a packaging container and a hearing aid disposed in the container. The container comprises an air-impermeable material and has a removal cap that forms an air-impermeable seal with the container. The hearing aid can be positioned on a compliant support coupled to the interior surface of the cap. The support and container protect the hearing aid from shock and vibration as well as reducing the application of force to sensitive components. The container can also include one or more structures for ESD protection.

20 Claims, 5 Drawing Sheets

HEARING AID PROTECTIVE PACKAGING ASSEMBLY

BACKGROUND OF THE INVENTION

Field of the Invention

Embodiments of the invention relate to protective packaging for battery-powered hearing devices. More specifically, embodiments of the invention relate to protective packaging for metal-air battery-powered hearing devices.

Owing to the aging populating in the U.S., many hearing aids and other hearing devices are coming into increasing use. In the Canal (ITC) and Completely-In-The-Canal (CIC) hearing aids are becoming increasingly popular with consumer. CIC hearing aids fit deeply within the ear canal and can be essentially hidden from view from outside the ear canal. Many hearing devices use a zinc air or other metal-air battery cell which relies on air (oxygen) in the environment as a source for their internal electrochemical reaction. These batteries are coming into increasing use in hearing device applications including use in ITC and CIC hearing aids including disposable CIC hearing aids due to their volumetric energy efficiency. These batteries derive their name and efficiency in that they use air (oxygen) as the cathode of the battery cell. The cathode typically comprises an electrolytic gel. An air hole in the cell allows oxygen from the environment to enter the cell into a cavity comprising the cathode and subsequently into the anodic electrolyte.

From a convenience standpoint, it is desirable to ship the hearing aid with a live battery that is integrated into the hearing aid. Also for some hearing aids, it is desirable to have the battery supply a minimum voltage to the hearing aid during shipping and storage in order to maintain values stored in volatile memory registers such that the hearing aid is immediately usable when removed from its packaging. At the same time, it is also desirable to store the hearing aid including the battery in air tight packaging to prevent exposure to carbon dioxide, excess oxygen and fluctuations in humidity. Carbon dioxide and excess oxygen can damage a zinc-air battery even when the battery is not coupled to a load. This is also the case for excess humidity which dilutes the electrolyte in the battery or too little humidity which can dry out the electrolyte. Current zinc-air battery manufacturers address these issues by placing an air impermeable film or other barrier over the battery air hole which must be removed prior to use of the battery.

The challenge arises in shipping hearing aids with integrated live zinc-air batteries in that these and other metal-air batteries usually require a minimum amount of oxygen and a certain range of humidity in order to reliably function and not undergo degradation in operating life. Thus, there is need for packaging which on the one hand protects the hearing device from contaminants and moisture excursions and on the other which allows for sufficient air and relative humidity to preserve battery and device function during shipping and storage. There is also a need for hearing device packaging which protects more sensitive hearing device components from damage due to mechanical shock and from static electric discharge.

BRIEF SUMMARY OF THE INVENTION

Embodiments of the invention provide packaging systems, assemblies and methods for packaging hearing devices including battery powered hearing devices with a pre-installed battery. Such embodiments allow for protection of the hearing devices during shipping and storage from potentially degradative environmental conditions such as high humidity, carbon dioxide and UV light exposure. Many embodiments provide packaging systems and assemblies that allow metal-air battery powered hearing aids and other hearing devices to be stored for several months or longer with a live battery and then ready for use upon opening of the packaging. Various embodiments also provide packaging systems that provide for protection of sensitive hearing device components from mechanical shock and electrostatic discharge (ESD) during shipping and storage. Particular embodiments also provide packaging systems with an irreversible thermal indicator to indicate if a packaged assembly has been exposed to a particular ambient temperature.

Many embodiments provide a packaging system for a hearing aid comprising a packaging container and a hearing aid disposed in the packaging container. The packaging container comprises an air-impermeable material and has a removal cap such as a screw type cap. The container will usually also be made of a conductive material such as aluminum. The removable cap forms an air-impermeable seal with the container. The container will typically be tube-shaped but can also have other shapes such as rectangular which are shaped to facilitate packing and/or protection. The hearing aid will typically be positioned on an elastomeric or other compliant support coupled to the interior surface of the cap or other portion of the container. The support together with the container provide a suspension mechanism that protects the hearing aid from mechanical shock and vibration as well as reducing the application of force to more sensitive components of the hearing aid (e.g., compliant seals) by isolating those component from contact with the container interior.

The hearing aid can include any number of battery powered hearing aids such as ITC and CIC hearing aids including extended wear hearing aids and hearing aids configured to be positioned in the bony portion of the ear canal. The hearing aid will typically be a zinc-air or other metal-air battery powered hearing aid (though other battery chemistries are equally suitable) and may have a low power operating mode for shipping and storage or other periods of non-use by the wearer. The low power mode allows the battery to supply current to the hearing aid to maintain stored values and/or programming in volatile memory resources such as RAM. The container is desirably assembled with sufficient oxygen and water vapor for the selected metal-air battery to operate within the container to power the hearing aid in the low power operating mode for an extended period of time, for example, six months or longer. This controlled atmosphere provided by the container also allows the battery to supply power for the hearing aid for normal use almost immediately (e.g. within several seconds) upon opening of the container and exposure to ambient air. Thus the container provides the hearing aid not only a protective environment for shipping and storage but also a ready to use capability upon removal from the container. In a related aspect, the container also provides a means for preserving and improving battery life during use of the hearing aid by protecting the hearing aid from various potentially degradating conditions including under or over exposure to oxygen, carbon dioxide and water vapor.

The container will also typically include one more bodies or structures for ESD protection described herein as ESDP structures. These can include an electro-statically dissipative body such as a foam insert as well as an electro-statically dissipative sleeve that fits around the hearing aid. Together, the foam insert and the sleeve provide a redundant level of ESD protection for the hearing aid. The level of ESD protection is further added to by the container itself being conductive to allow the dissipation of electrostatic charge.

In another aspect, embodiments of the invention also provide a means for the user to determine if the container was exposed to potentially damaging thermal conditions through the use of an irreversible thermal indicator. Typically, the thermal indicator will be a color indicator that can be affixed to an exterior of the container. The indicator can be configured to undergo an irreversible color change when exposed to a particular temperature condition that may have damaged or otherwise compromised performance of the hearing aid. Multiple indicators can be used to alert the user of both high and low temperature conditions (e.g., boiling or freezing point).

In an exemplary embodiment for using the invention, a packaging container can be selected for a particular hearing aid such as a zinc air battery powered hearing aid. The hearing aid can be programmed with one or more stored values or electronic instruction sets stored in either volatile memory or non volatile memory resources. The hearing aid is placed in the container and the container is sealed (e.g., via a screw cap) with a selected amount of oxygen and water vapor to allow the battery to function in a low power state for a selected time period to maintain the stored memory values or perform other selected functions. This can be achieved by packing the container under controlled ambient conditions (e.g., controlled humidity oxygen, etc). The amounts of oxygen and water vapor (e.g., moles) can be titrated depending upon the selected battery chemistry, storage period and power levels. The hearing aid can then be operated in the lower power mode to retain the stored memory values while the hearing aid is shipped and/or stored on the shelf. Upon opening of the container and exposure to ambient air, the hearing aid can then switch to a higher power operating mode so as to be operable for use in the ear of a wearer. Switching between the modes can be effectuated using a contact actuated switch or a remotely activated switching device such as a magnetic, acoustic or optical switch. Alternatively, the hearing aid can include a sensor to detect a change in ambient air conditions (e.g., oxygen content) and then signal that change to a processor or other logic resources controlling power management of the hearing aid.

While various aspects of the invention are directed to packaging assemblies for battery powered hearing devices, other aspects are directed to packaging systems for shipping and storage of other battery powered electronics devices which allow for immediate device use upon removal from packaging. Such devices can include flashlights, watches, calculators, pda's, cell phones, video games, and like devices. The package size, internal air volumes and humidity levels can be matched to the particular device, battery chemistry and desired shelf life.

DETAILED DESCRIPTION OF THE INVENTION

Figure 1A:
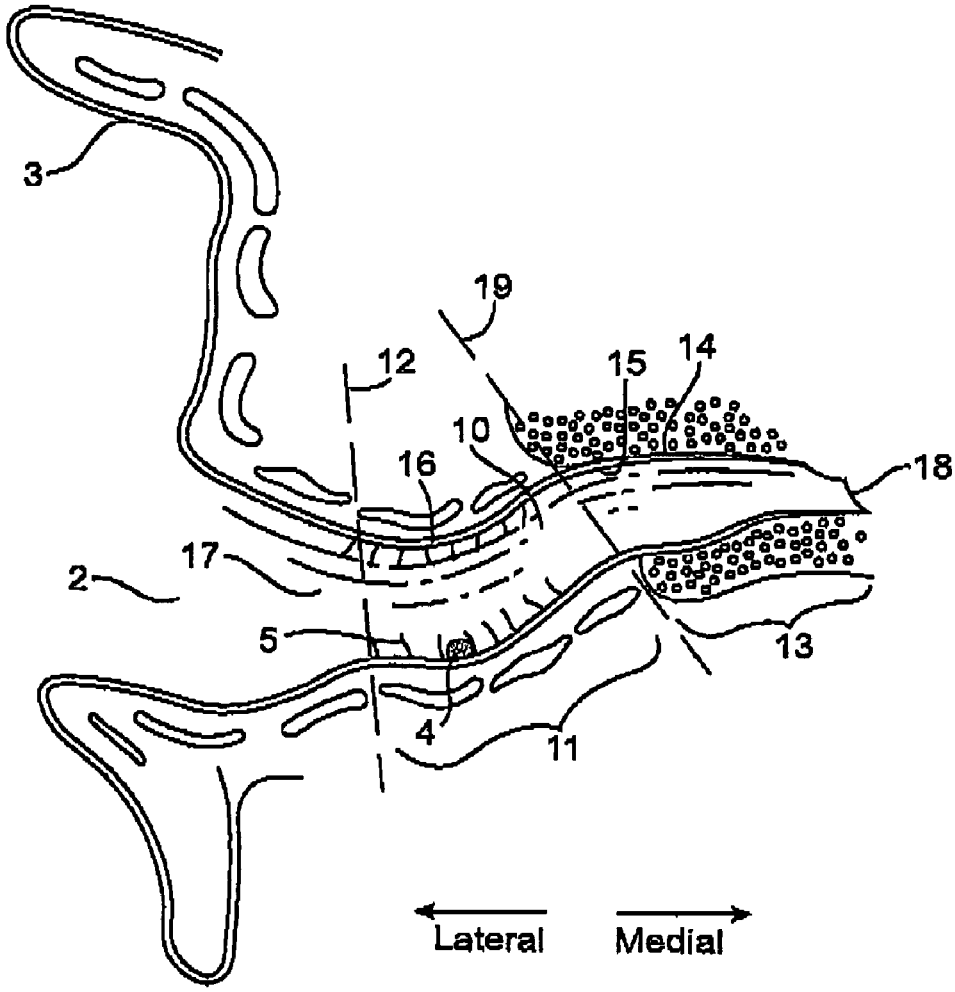
FIG. 1A is a side coronal view of the external ear canal.
Figure 1B:
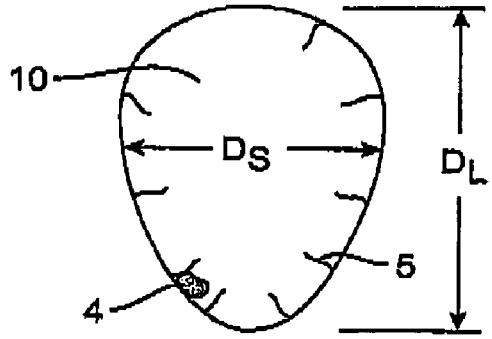
FIG. 1B is a cross-sectional view of the ear canal in the cartilaginous region.

Various embodiments of the invention provide packaging systems, assemblies and methods for packaging of hearing devices including battery powered hearing devices with a pre-installed battery. These and related embodiments allow for protection of a hearing devices during shipping and storage from potentially degradative environmental conditions as wells as from mechanical shock and vibration and electrostatic discharge Since many embodiments of the invention provide a packaging assembly for hearing devices positioned in the ear canal, a brief description of the anatomy of the ear canal will now be presented for purposes of illustration. While the shape and structure, or morphology, of the ear canal can vary from person to person, certain characteristics are common to all individuals. Referring now to FIGS. 1A-1B, the external acoustic meatus (ear canal) is generally narrow and contoured as shown in the coronal view in FIG. 1A. The ear canal 10 is approximately 25 mm in length from the canal aperture 17 to the center of the tympanic membrane 18 (eardrum). The lateral part (away from the tympanic membrane) of the ear canal, a cartilaginous region 11, is relatively soft due to the underlying cartilaginous tissue. The cartilaginous region 11 of the ear canal 10 deforms and moves in response to the mandibular (jaw) motions, which occur during talking, yawning, eating, etc. The medial (towards the tympanic membrane) part, a bony region 13 proximal to the tympanic membrane, is rigid due to the underlying bony tissue. The skin 14 in the bony region 13 is thin (relative to the skin 16 in the cartilaginous region) and is more sensitive to touch or pressure. There is a characteristic bend 15 that roughly occurs at the bony-cartilaginous junction 19 (referred to herein as the bony junction), which separates the cartilaginous 11 and the bony 13 regions. The magnitude of this bend varies among individuals.

A cross-sectional view of the typical ear canal 10 (FIG. 1B) reveals generally an oval shape and pointed inferiorly (lower side). The long diameter ($D_L$) is along the vertical axis and the short diameter ($D_S$) is along the horizontal axis. These dimensions vary among individuals.

Hair 5 and debris 4 in the ear canal are primarily present in the cartilaginous region 11. Physiologic debris includes cerumen (earwax), sweat, decayed hair, and oils produced by the various glands underneath the skin in the cartilaginous region. Non-physiologic debris consists primarily of environmental particles that enter the ear canal. Canal debris is naturally extruded to the outside of the ear by the process of lateral epithelial cell migration (see e.g., Ballachanda, The Human Ear Canal, Singular Publishing, 1995, pp. 195). There is no cerumen production or hair in the bony part of the ear canal.

The ear canal 10 terminates medially with the tympanic membrane 18. Laterally and external to the ear canal is the concha cavity 2 and the auricle 3, both also cartilaginous. The junction between the concha cavity 2 and the cartilaginous part 11 of the ear canal at the aperture 17 is also defined by a characteristic bend 12 known as the first bend of the ear canal.

Figure 2:
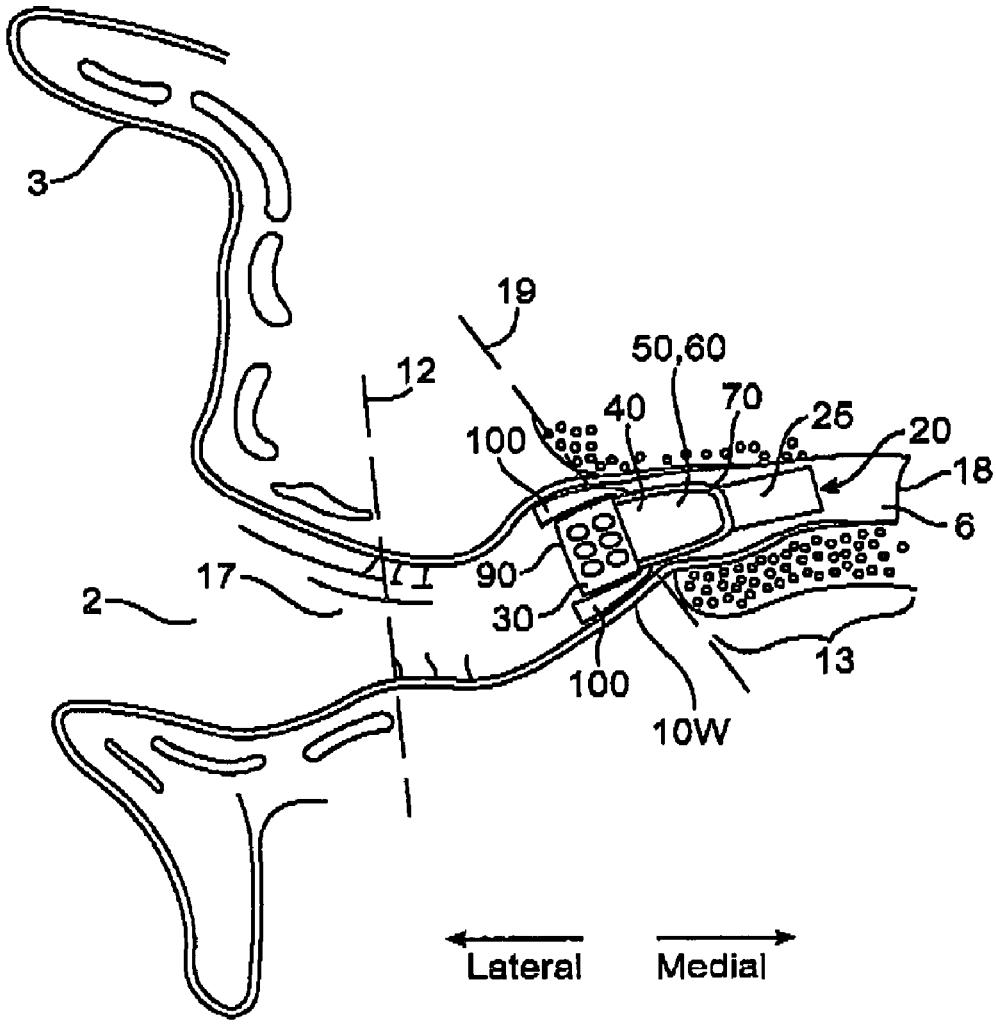
FIG. 2 is a lateral view illustrating an embodiment of a hearing aid device positioned in the bony portion of the ear canal.
Figure 3:
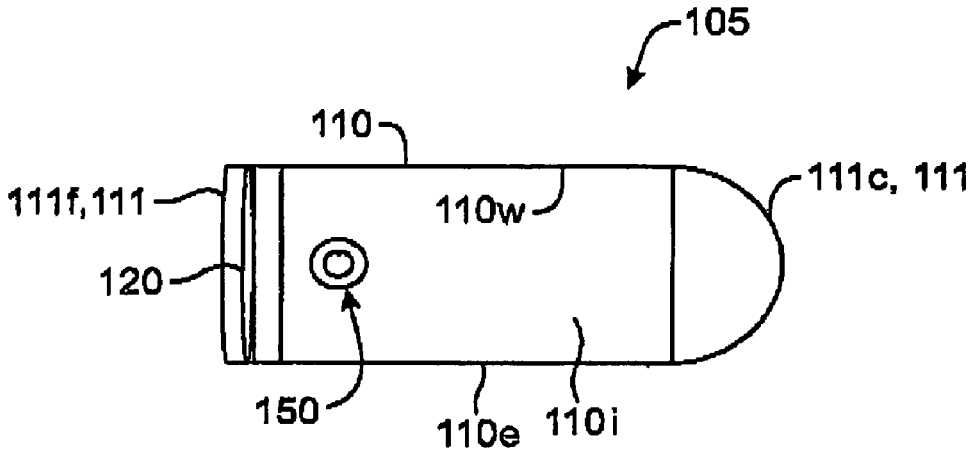
FIG. 3 is a perspective view illustrating an embodiment of a hearing device packaging assembly.
Figure 4:
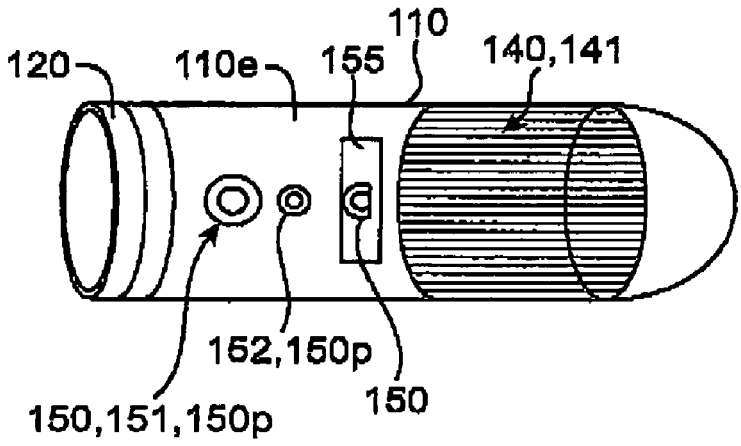
FIG. 4 is a top view of an embodiment of a hearing device packaging assembly.
Figure 5A:
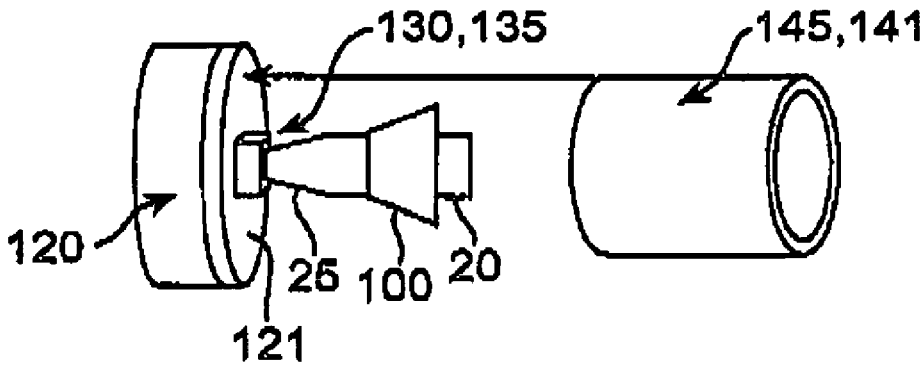
FIG. 5A is an exploded view illustrating placement of a hearing device within the packaging assembly as well as use of a static dissipative sleeve.
Figure 5B:
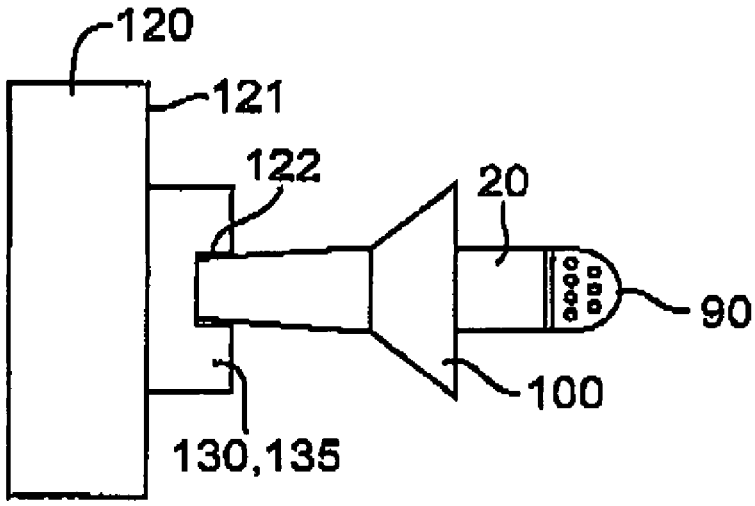
FIG. 5B is a lateral view illustrating engagement of the hearing device with the support.
Figure 6:
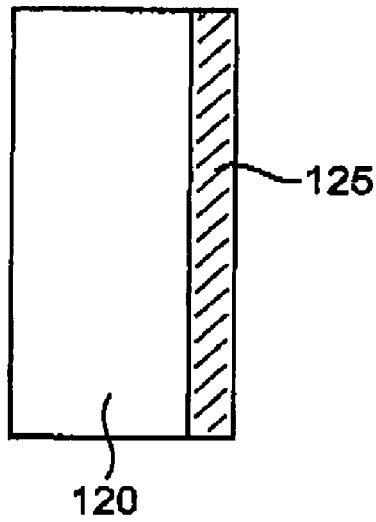
FIG. 6 is a later view illustrating an embodiment of the cap having a gasket.
Figure 7:
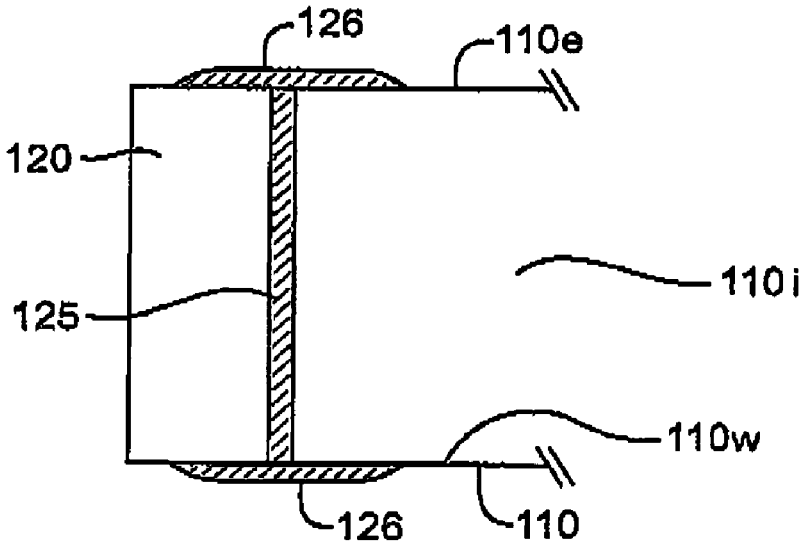
FIG. 7 is a later view illustrating an embodiment of the cap having an external seal.

Hearing devices which can be utilized with various embodiments of the invention can include BTE, ITC and CIC hearing aid devices. In preferred embodiments, the hearing device is a CIC hearing aid device. These devices fit deep within the ear canal and can be essentially hidden from view from outside the ear canal. Referring now to FIG. 2, an embodiment of a CIC hearing aid device 20 for use in ear canal 10 typically includes a receiver assembly 25 (also called speaker assembly 25), a microphone assembly 30, a battery assembly 40, a cap assembly 90 and one or more sealing retainers 100 (also called seal 100) that can be coaxially positioned with respect to receiver assembly 25 and/or microphone assembly 30. Receiver assembly 25 is configured to supply acoustical signals received from the microphone assembly to a tympanic membrane of the wearer of the device. One or more of the microphone assembly, the receiver assembly or the battery assembly can include an integrated circuit (i.e., an IC) that comprises one or more volatile memory resources such as RAM for storing programs and data used to control and operate the hearing aid. In many embodiments, the microphone assembly will be coupled to the IC.

Battery assembly 40 includes a battery 50, and can also include a battery barrier 60 and a battery manifold 70. Battery 50 can utilize various electrochemistries known in the art including alkaline, lithium, lithium ion and the like. In preferred embodiments, battery 50 is a zinc-air or other metal-air battery known in the art. Examples of suitable metal-air batteries and battery assemblies are further described in U.S. Pat. Nos. 6,567,527 and 6,751,327 which are fully incorporated herein by reference CIC hearing device 20 can be configured for extended continuous or near continuous wear in ear canal 10 or daily wear in which the device is removed daily (or other set interval) from the ear canal. Preferably, device 20 is also configured for placement and use in the bony region 13 of canal 10 so as to minimize acoustic occlusion effects due to residual volume 6 of air in the ear canal between device 20 and tympanic membrane 18. In specific embodiments, hearing device 20 can be a battery powered extended wear device configured to be worn continuously in the ear canal for 3 to 6 months or even longer. For ease of discussion, hearing device 20 will now be referred to as a hearing aid 20, which typically is a CIC hearing aid, but other hearing aids described herein are equally applicable.

Referring now to FIGS. 3-7, an embodiment of a hearing device packaging assembly 105 includes a packaging container 110 having an interior space 110*i* (also called interior 110*i* ) configured to hold a hearing aid 20. Container 110 is fabricated to be air-impermeable and includes a removable cap 120 which forms an air-impermeable seal with the container. The container can also include a support 130 for supporting the hearing aid in as one or more electrostatic discharge protective (ESDP) structures 140 for protection of the hearing aid of the from electrostatic discharge. ESDP structures 140 can comprise static dissipative materials, antistatic materials and conductive materials. Antistatic materials have a resistivity generally between $10^9$and $10^{12}$ohms per square and tend to suppress initial electrostatic charges. Static dissipative materials have a resistivity generally between $10^6$and $10^{12}$ohms per square, have a low or no initial charge and prevent discharge to/from human contact. Conductive materials have a resistivity generally between $10^3$and $10^6$ohms per square, develop little if any initial charges and provide paths for charge to bleed off. For ease of discussion, when a material herein is described as being more electro-statically dissipative or more conductive it indicates that the material has a lower surface resistivity. ESDP structures 140 can include an ESDP body 141 such as a foam insert and an ESDP sleeve 145. In many embodiments, body 141 and sleeve 145 comprise electrostatic dissipative materials and are thus are a electrostatic dissipative body 141 and sleeve 145. The container can also include an irreversible thermal indicator 150 for alerting the user if the container has been exposed to a particular thermal condition, e.g., a temperature above or below a selected level.

In most embodiments, the container is fabricated from an air-impermeable material and forms an air-impermeable seal with cap 120 which is itself formed from an air-impermeable material. As used herein, air-impermeability does not mean absolutely air tight but a level of permeability below a selected level. Impermeability can be measured using one or more tests known in the art, e.g., a helium leak/flow test using mass spectrometry detection. Desirably, the container and the cap are fabricated to have a helium flow rate less than about $10^{-4}$ cc per second.

In preferred embodiments, the container comprises bare aluminum. Alternatively, it may also comprise stainless steel, high carbon steel, brass, bronze and alloys thereof or more of which may be coated or plated using (e.g., electroplating, etc.) to avoid oxidation and corrosion. These materials are desirably fabricated to be air-impermeable. Selection of a conductive material for the container is desirable to lessen the buildup of static electricity on the container.

The container is shaped and sized to preferably hold one hearing aid, but may also hold two (e.g., a left and a right hearing aid) or another selected number. The container is also shaped and sized to hold a selected volume of air is discussed further herein. In one embodiment, the container can be at least partially tube shaped, but may also have a rectangular or other shape. The shape, strength and dimensions (e.g., wall thickness) of the container can also be selected to resist crushing at a selected load during shipping and storage. One or both of the ends 111 of the container can be a flat end to allow the container to be stood upright during shipping or display on the shelf. In a preferred embodiment shown in FIG. 3, the container has a cigar tube shape with a flat end 111*f* (formed by cap 120) and a curved end 111*c*.

Preferably, cap 120 is a screw type cap but can also be a snap on or a key type cap or have an interlocking channel (not shown) with the container. The cap comprises an air impermeable material preferably bare aluminum. Alternatively, it may also comprise stainless steel, high carbon steel, brass, bronze one or more of which may be coated or plated. Preferably, the cap includes an internal gasket 125 adhered to its inner face 121 to aid in forming a seal with the container 110. Gasket 125 can comprise rubber or other compliant polymer known in the art. Also an external seal 126 (e.g., shrink wrap plastic) can be applied around the cap exterior to provide and additional level of sealing as well as to indicate if the cap has been removed. The external seal is thus desirably air-impermeable and easily removed. Removal can be facilitated by a perforated or other tearable section. Suitable seal materials can include PVC (polyvinyl chloride) including PVC's compounded with PVDC (polyvinylidene chloride)and composites of aluminum and other polymers such as polyethylene, ethylenevinyl acetate and the like. In use, cap 120 provides the user with easy access to a protectively packaged hearing aid through an easy open mechanism while the shrink wrap provides an added level of sealing and packaging security Support 130 is configured to support hearing aid 20 within container 110. In many embodiments, the support is configured to provide mechanical shock and vibration protection to the hearing aid. Accordingly in these and related embodiments, the support can comprise a compliant material having selected mechanical and physical properties (e.g., thickness, durometer, etc.) to act as a shock absorbing assembly 135 to dampen or otherwise attenuate mechanical shock and vibration transmitted from the container to the hearing aid. Suitable materials for support 130 include silicone rubber or other elastomer (e.g., polyurethane) or compliant polymer known in the art. Typically the support is adhered to an inner face 121 of cap 120. In preferred embodiments, the support is adhered to the cap interior using a USP Class VI adhesive such as cyanoacrylate. The support may also be coupled to an opposite inner end of the container or the inner walls 110*w*of the container (e.g., along the perimeter of the support). The support can have a variety of shapes, square, rectangular, circular etc and is sized to be able to support the hearing aid within the container. It may also have an indentation or recess shaped to engage and hold (e.g., via an interference fit) a portion of the hearing aid 20, such as a portion of the receiver assembly 25. The hearing aid can be coupled to the support, via the recess, through a releasable adhesive or it may merely rest on the support and be held in place through use of a foam insert described herein.

In specific embodiments, the support 130 is sized and shaped and otherwise configured to support the receiver end of the hearing aid so that hearing aid stands upright in the container. This arrangement is also configured to suspend the hearing aid within the container to mechanically isolate it from shock and vibration and protect fragile hearing aid components such as deformable seals 100 from deformation when placed in the container. The latter is accomplished by supporting the hearing aid so as to isolate the seals or other component from contact with the walls of the container. In use, the compliant support provides a means for protecting the hearing aid from mechanical shock and vibrations during shipping and storage and preventing deformation of the hearing aid seals. This provides for improved reliability and fit of the hearing aid even after being stored for several months or longer.

Various embodiments of packaging system 105 also provide ESD protection to packaged hearing aid 20. This can be accomplished through the use of one or more ESDP structures 140 comprising electro-dissipative materials. Structures 140 can include bodies, sleeves, linings and the like. The amount of ESD protection can be adjusted through the shape, size, number and composition of ESDP structures 140. In the embodiments shown in FIGS.. 5A-5B, structures 140 can include a body 141 and a sleeve 145. Body 141 will typically comprise a polymer foam insert having a cylindrical or other shape corresponding to the interior 110*i*of container 110; however other shapes may also be used. Foam inset 141 can comprise an open or closed cell foam; polyethylene, LDPE or polyurethane, or other foam polymer known in the art. Desirably, the insert has a surface resistivity of less then about 1012ohms/square inch and a static decay in the range of between about 5 KV to 0.00 1 KV in less than about 2.0 seconds. These properties can be measured using one or more ASTM tests known in the art such as a static decay test. The ESD protection of the foam insert can be achieved through the use of one or more anti-static, statically dissipative and/or conductive additives known in the art that are homogenized into thepolymer during the fabrication process. Desirably these additive are selected so that the ESD properties of the insert have reduced humidity dependence. The insert also desirably has cushioning properties as well. This can be achieved through the selection of the material, and one or more material properties such as density which can be in the range of 1.4 to 2.2 pounds per cubic foot.

Sleeve 145 can comprise a variety of polymers, but in preferred materials comprise a polyolefin with one or more antistatic additive homogenized into the polymer. The sleeve can be fabricated from an tube (e.g., formed by extrusion) or a rolled sheet. Typically, the sleeve will be coupled to cap inner surface 120*i* via an adhesive or other joining means. The sleeve is sized to fit over and around the hearing aid 20 and can have diameter approximating the inner diameter of container 110. The sleeve length preferably extends at least the length of hearing aid 20, but can be longer. In preferred embodiments, the sleeve is configured to fit over the entire hearing aid and be removable from the container when the user or doctor removes the hearing aid from the container. In use, this configuration provides continued ESD protection even after the hearing aid has been removed from the container.

Together body 141 and sleeve 145 provide an augmented level of ESD protection as well a redundant/fault tolerant level of ESD protection such that any charge that is not dissipated by one structure will be dissipated by the other. The level of ESD protection of the system 105 and container 110 can be further augmented through the use of conductive materials on the container which serves to prevent or reduce the build-up of a static electric charge on the outside of the container.

Turning now to a discussion of thermal indicator 150, in various embodiments, the indicator can be configured to undergo a visual change to alert the user if container 110 has been exposed to a selected ambient temperature threshold. This threshold can be either a high or low threshold. In preferred embodiments, the indicator is configured to undergo an irreversible color change (e.g., from green to red, or transparent to colored) when the selected temperature threshold has been exceeded. In particular embodiments, the indicator is configured to undergo a color change when the container is at any time exposed to an ambient temperature of 50° C. or greater such as might occur during shipping or storage. The indicator can employ various temperature sensitive chromophore technology known in the art. The indicator can be adhesively or otherwise attached to any location on the exterior surface 110*e* of the container but is preferably to a more central location on the container so as to be readily visible to the user. The indicator can also be placed on a label 155 with text and/or colors indicating when not to use the hearing aid and the specific colors that prompt the warning. In preferred embodiments, the indicator comprises a temperature sensitive dot that may placed over or adjacent a warning label 155. The indicator can be applied to the label using spraying, silk screening, photolithography or stamping techniques or it may be adhered.

In various embodiments, indicator 150 can comprise a plurality of indicators 150p such as a first and a second indicator 151 and 152, with one indicator configured to undergo a color change at a first temperature (e.g., an upper threshold) and the other at another temperature (e.g., a lower threshold, e.g., 0° C.). In this way the indicators provide a warning over a bracketed range of adverse thermal conditions so as to provide an increased level of reliability to the user.

A discussion will now be presented on the volume and gaseous composition within the container interior. In various embodiments, the container has a gaseous composition (also described as atmosphere) configured to allow the battery assembly to supply power to the hearing aid for the hearing aid to operate in a lower power mode within the container for an extended period of time (e.g., three months or even six months) and then be ready to use in a high power mode. Operation in the low power mode allows the battery to supply sufficient current (e.g., a trickle current) to maintain the contents of one or more memory registers stored in non volatile memory resources (e.g., RAM) integral to or otherwise coupled to the hear aid. This in turn allows the hearing aid to be ready for immediate use in a higher power mode after removal from the container. The contents of the memory registers can include data, programs and the like.

Performing one or more of the above operations typically entails the container having a selected amount of oxygen (e.g., moles) and a selected range of relative humidity. In many embodiments, these requirements can be met through the use of atmospheric air (having a known oxygen content e.g., approximately 21% by moles) which is also humidity controlled. In various embodiments, the container can hold between 1 to 40 cc of air with specific embodiments of 5, 10, 15, 20, 22, 25, 3 0 and 35 cc. Also the relative humidity can be in the range from about 50 to 80% with a specific embodiments of 55, 60, 70 and 75%. The amount of oxygen and other gases in the container can be sampled and adjusted using various commercially available control gases having known amounts (e.g. moles) of oxygen, nitrogen etc. Sampling can be accomplished using one or more oxygen sensors or using a GC-mass spectrometer. The volume of air required (and thus volume of the container interior) can be stochiometrically determined based on the characteristics of the selected zinc air battery (e.g., capacity, etc), the power requirements of the hearing aid in the low power mode (also known as the shipping mode), the desired storage life and the partial pressure of oxygen in the air. Greater air volumes, and thus container volumes, can be used when longer periods of storage are desired for the packaged hearing aid. For example, a hearing device that draws 5 micro-Amperes (μA) while in shipping mode, requires 5 μA×24 hours, or 120 μAh of energy capacity to be drawn from the battery per day. For six months of storage life, this works out to 21,900 μAh (120 μAh ×182.5 days) of energy capacity. One cubic centimeter (1 cc) of air at sea level contains approximately 0.21 cc of oxygen at STP conditions. Based on the stochiometry of the zinc/zinc oxide (Zn-ZnO) reaction used in a zinc-air battery, 0.21 cc of oxygen (and therefore 1 cc of air at STP) yields approximately 1,000 μAh of energy capacity. Therefore, the device of this example would require approximately 21.9 cc (i.e., 21,900 μAh/1,000 μAh/cc air) of air to provide power for a storage period of six months. A three months storage period would require roughly half this amount or 11 cc of air. Devices drawing higher currents, for example 10 vs. 5 μA would require approximately twice the volume of air for the same storage period. In various embodiments, hearing devices packaged in the container can be configured to draw between 0.1to 100 μA of current in the shipping mode, with specific embodiments of 0.5, 1, 2.5, 5, 10, 20, 25, 30, 50, 75,and 80, and 90 μA. (Higher or lower currents can be used depending on the memory devices used, number of memory registers to be preserved, memory and other chip architecture utilized by the hearing device, etc). Accordingly, the stochiometric determination of the amount of air in these embodiments, can be based on these current levels using a zinc-air or other metal-battery, such as an aluminum-air battery.

In various embodiments, the container can be configured to hold sufficient air for the hearing aid to operate in a low power mode for periods of one, two, three, four, five, six months and longer. The volume of container to hold the required air can be adjusted depending upon the volume of the hearing aid as well as the volume of the support and ESDP structures. Humidity can be controlled by packing the container in a controlled humidity environment. Also the gaseous content of the atmosphere in the container (e.g., oxygen, nitrogen, $CO_2$, etc) can be adjusted as well, e.g., using control gases that used in place of in conjunction with atmospheric air. The content of the container atmosphere is desirably controlled to not only allow the battery to operate for selected periods of time in a low power mode, but also do so with minimal or no degradation to battery performance (e.g., capacity, etc.) when the hearing aid is removed from the container and used in a higher power operating mode. This can be facilitated by keeping the relative humidity within the container in the ranges specified as well as minimizing the amount of carbon dioxide in the container. In addition to stochiometric determinations, specific battery life performance tests can be done to refine the gaseous content within the container for producing optimal battery life for a given battery operating in the shipping mode. For example, experiments can be done to measure battery capacity at a particular load and atmospheric content of the container. The tests can be done using one or more ASTM or other standard battery life test methods known in the art. Various numerical methods (e.g., Newton-Raphson, Euler, cubic spline, design of experiment methods, etc ) known in the engineering arts can be used to further refine the atmospheric content for optimal battery life within the container. Also the desired atmospheric content of a given container can be optimized by doing a specific performance test on a given hearing aid and battery combination to determine a battery performance parameter (e.g., current drain, or slope of a battery voltage vs. time curve in given operational mode) and then calibrate the exact amount of gas in the container using that performance parameter. A mathematical model can be developed correlating the battery performance parameter to shelf life for a given battery type. The model can be based on a first order, second order or multivariate analysis.

ALTERNATIVE EMBODIMENTS

As described above, in various alternative embodiments, the cap can be a snap on, interlocking channel, or key fitted cap. Also it may have a seal around all a portion of it, such as a shrink wrap or like seal to alert the user if the cap has been removed. The foam insert and sleeve can also made more or less electrostatically-dissipative depending on the degree of ESD protection required. Additional ESDP structures can be added to achieve other desired levels of ESD protection. In one embodiment, an ESDP packing can be used to fill all or a portion of the container.

In other alternative embodiments, the container can include one or more of a desiccant, an oxygen scavenging material, a carbon dioxide scavenging material or other gas scavenging material known in the art to help control the internal atmosphere in the container. Also the container can be charged with one or more inert gases such as nitrogen. In still other alternative embodiments, the container can include one or more Rf-ID devices (e.g., Rf-ID tags) configured to signal various manufacturing data (e.g., lot number, manufacturing date, model number, serial number, battery type, shelf life and the like) to one or more of a hand held receiver, a pda, a cell phone, a computer, a networked device, a network, a distributed network or the Internet. Alternatively, the manufacturing or other data can be stored on a bar-code label or other optically readable indicia adhered to the container. These data can be used for one or more of inventory control, sales and marketing purposes. In one embodiment of a method of use of such systems, the retailer can use the Rf-ID tags to do inventory auditing to determine what product is in on the shelf and how much more storage life each individual container has. Also the manufacturer or wholesaler can receive data over the Internet or other network to make similar determinations and use this data to do one or more of the following: i) alert the retailer of potentially expiring product; ii) plan future manufacturing builds; iii) order part using a JIT or other inventory management system; and iv) determine sales rates and shelf residency times for a given product in a given store or geographic region.

In still other embodiments, the container can be shaped and charged with sufficient air to store various other battery powered electronic devices such as flashlights, watches calculators, pda's, cell phones and the like in a sleep mode for a selected storage period.

CONCLUSION

The foregoing description of various embodiments of the invention has been presented for purposes of illustration and description. It is not intended to limit the invention to the precise forms disclosed. Many modifications, variations and refinements will be apparent to practitioners skilled in the art. Further, the teachings of the invention have broad application in not only in the hearing aid device, but also the miniature electronics fields as well as other fields which will be recognized by practitioners skilled in the art.

Elements, characteristics, or acts from one embodiment can be readily recombined or substituted with one or more elements, characteristics or acts from other embodiments to form numerous additional embodiments within the scope of the invention. Moreover, elements that are shown or described as being combined with other elements, can in various embodiments, exist as stand alone elements. Hence, the scope of the present invention is not limited to the specifics of the exemplary embodiment, but is instead limited solely by the appended claims.

What is claimed is:

1. A hearing aid packaging system comprising:

a packaging container comprising an air-impermeable material;

a removable cap forming an air-impermeable seal with the container; and a hearing aid disposed within the container, the hearing aid having a low power operating mode, a volatile memory, and a metal-air battery for powering the hearing aid in the low power mode; and wherein a sealed volume of the container has sufficient oxygen and water vapor for the battery to operate within the container to power the hearing aid in the low power operating mode for an extended time period so as to maintain the volatile memory during said extended time period.

2. The assembly of claim 1, wherein the container is tube-shaped.

3. The assembly of claim 1, wherein the container is electrically conductive.

4. The assembly of claim 1, further comprising:

a compliant support coupled to the cap interior surface, wherein the hearing aid is positioned on the support.

5. The assembly of claim 4, wherein the support is configured to function as a shock absorber to provide protection to the hearing aid from external vibration or shock.

6. The assembly of claim 4, wherein the support is coupled to an end of the hearing aid so as to mechanically isolate the hearing aid from a container interior surface.

7. The assembly of claim 4, wherein the support is coupled to an end of the hearing aid so as to suspend the hearing aid within the container.

8. The system of claim 1, further comprising:

at least one of an ESD protective body disposed within the container or an ESD protective sleeve coupled to a cap interior surface.

9. The system of claim 8, wherein at least one of the ESD protective body or sleeve comprises an electrostatic dissipative material.

10. The system of claim 1, further comprising:

an irreversible thermal indicator coupled to the container for detecting a thermal condition within the container, the indicator including an indicator region visible from a container exterior surface.

11. The system of claim 1, wherein the extended time period is up to about six months.

12. The system of claim 1, wherein the sealed volume of the container has sufficient oxygen and water vapor for the battery to operate within the container to power the hearing aid in the low power operating mode for the extended time period and then power the hearing aid in a higher power mode when the container is opened.

13. The system of claim 1, wherein the battery is a zinc-air battery.

14. The system of claim 1, wherein the hearing aid is a continuous wear hearing aid.

15. The system of claim 1, wherein the hearing aid is configured to be worn in the bony portion of the ear canal.

16. A method of packaging a metal-air battery powered hearing aid for an extended storage period, the method comprising:

storing a value in a volatile memory register of the hearing aid;

placing the hearing aid in an air-impermeable container;

sealing the hearing aid in the container under controlled conditions, wherein a sealed volume of the container has sufficient oxygen and water vapor for the battery to operate within the container to power the hearing aid in a low power operating mode for the extended storage period; and operating the hearing aid in the low power operating mode within the sealed container to maintain the value stored in the volatile memory register.

17. The method of claim 16, wherein the hearing aid is operated in the low power mode in the container for the extended storage period.

18. The method of claim 17, wherein the extended storage period is up to about six months.

19. The method of claim 16, further comprising:

opening the container; and using the hearing aid in a higher power mode.

20. The method of claim 19, where in the hearing aid is used in the higher power mode substantially immediately after the hearing aid is exposed to ambient air.

* * * * *